US011524288B2

(12) United States Patent
Stankus et al.

(10) Patent No.: US 11,524,288 B2
(45) Date of Patent: Dec. 13, 2022

(54) DEVICE FOR SAMPLE ANALYSIS

(71) Applicant: Diagnostics for the Real World, LTD., San Jose, CA (US)

(72) Inventors: Philip Stankus, Coldwaltham (GB); Ivan Hin-Kwan Chew, Alameda, CA (US)

(73) Assignee: Diagnostics for the Real World, LTD., San Jose, CA (US)

( * ) Notice: Subject to any disclaimer, the term of this patent is extended or adjusted under 35 U.S.C. 154(b) by 0 days.

(21) Appl. No.: 16/769,189

(22) PCT Filed: Dec. 20, 2018

(86) PCT No.: PCT/US2018/066874
§ 371 (c)(1),
(2) Date: Jun. 2, 2020

(87) PCT Pub. No.: WO2019/126545
PCT Pub. Date: Jun. 27, 2019

(65) Prior Publication Data

US 2020/0346206 A1 Nov. 5, 2020

(30) Foreign Application Priority Data

Dec. 20, 2017 (GB) ..... 1721385

(51) Int. Cl.
*B01L 3/00* (2006.01)

(52) U.S. Cl.
CPC ..... *B01L 3/502* (2013.01); *B01L 2300/045* (2013.01); *B01L 2300/047* (2013.01);
(Continued)

(58) Field of Classification Search
CPC ..... B01L 3/502; B01L 2300/045; B01L 2300/047; B01L 2300/049; B01L 2300/0663; B01L 2400/0644
See application file for complete search history.

(56) References Cited

U.S. PATENT DOCUMENTS 7,763,470 B2 * 7/2010 Babic ..... G01N 33/558 436/63
2006/0008847 A1 * 1/2006 Ramel ..... G01N 33/558 435/7.1

(Continued)

FOREIGN PATENT DOCUMENTS

CN 1683218 A 10/2005
CN 1688882 A 10/2005

(Continued)

*Primary Examiner* — Dennis White
(74) *Attorney, Agent, or Firm* — Bozicevic Field & Francis, LLP; Paula A. Borden; Mandar A. Joshi

(57) ABSTRACT

A device for analysing a sample comprising a nucleic acid to be captured and detected using a test strip are described. The device comprises a resilient biasing member disposed in an analysis chamber containing the test strip. The resilient biasing member exerts a force against the test strip sufficient to urge it into the sample chamber when it is in communication with the analysis chamber. This ensures that the test strip is reliably introduced into the sample chamber when it is in communication with the analysis chamber. In one embodiment, the sample chamber comprises guide members for guiding the test strip into the sample chamber. A free end of each guide member is shaped to prevent significant rotation of the test strip, so that the test strip is in correct alignment in the sample chamber for automatic reading of the test result, for example by a camera or optical reader.

19 Claims, 3 Drawing Sheets

(52) U.S. Cl.
CPC . *B01L 2300/049* (2013.01); *B01L 2300/0663* (2013.01); *B01L 2400/0644* (2013.01)

(56) References Cited

U.S. PATENT DOCUMENTS

| | | | | |
|---|---|---|---|---|
| 2008/0060424 | A1 | 3/2008 | Babic et al. | |
| 2012/0199601 | A1 | 8/2012 | Sawa | |
| 2014/0072960 | A1 | 3/2014 | Lansing | |
| 2016/0033543 | A1* | 2/2016 | Stankus ..... | C12Q 1/703 435/6.12 |

FOREIGN PATENT DOCUMENTS

| | | | |
|---|---|---|---|
| CN | 101610845 | A | 12/2009 |
| DE | 10 2013 220064 | B3 | 12/2014 |

* cited by examiner

DEVICE FOR SAMPLE ANALYSIS

This invention relates to devices for analysing a sample, in particular a sample comprising a nucleic acid to be captured and detected using a test strip.

WO 2008/012550 and WO 2014/140640 describe devices, systems, and methods for processing biological samples. According to such methods, a nucleic acid extracted from a biological sample is specifically amplified (using a procedure such as reverse-transcription polymerase chain reaction (RT-PCR), or an isothermal amplification procedure such as a transcription-based amplification system (TAS)).

The amplified nucleic acid is captured and detected using a test strip, which provides a visually readable result. Amplification, and capture and detection of amplified nucleic acid, takes place in an amplification device.

The amplification device disclosed in WO 2008/012550 may be operated manually by a user, and may include: a location apparatus having an input port for receiving a sample and one or more reagents; a sample chamber (referred to as a processing chamber in WO 2008/012550) for receiving the sample having a first opening; an analysis chamber containing a test strip for analysing the sample after processing, the analysis chamber having a second opening; the sample chamber being movable relative to the analysis chamber and the input port to enable communication between the sample chamber and the input port when the first opening is disposed in an overlapping relationship with the input port and communication between the sample chamber and the analysis chamber when the first opening is disposed in an overlapping relationship with the second opening; and a sealing apparatus for sealing the sample chamber and the analysis chamber during processing of the sample.

Alternatively, the amplification device may be configured to be operated automatically by the system described in WO 2014/140640. WO 2014/140640 describes an automated biological-sample-processing system comprising a pipette, a transport apparatus, an air-piston apparatus and an adaptor for coupling the pipette to the transport apparatus and to the air-piston apparatus, in which the adaptor is removably engageable with the transport apparatus and the air-piston apparatus for movement with the transport apparatus during processing of the sample, and is couplable to the pipette so that the transport apparatus is controllable to position the pipette and so that the air-piston apparatus is controllable to draw a liquid into the pipette and to expel the liquid from the pipette, in which the adaptor comprises a filter for preventing liquid or aerosol transfer between the pipette and the air-piston apparatus. The amplification device may have a similar construction to the manually operated amplification device described in WO 2008/012550 but may be configured to engage with the adaptor described in WO 2014/140640.

For the amplification devices described in WO 2008/012550 and WO 2014/140640, gravity acts to introduce the test strip into the sample chamber. Processed sample (a solution containing amplified nucleic acid) in the sample chamber travels up the test strip by capillary action, where it is captured and detected at a capture zone of the test strip. The result of the test may be read by visually inspecting the test strip.

In the system described in WO 2014/140640, the result may be read automatically using a camera, such as a line scan camera, to determine if particular lines on the test strip are present or not using a suitable image processing algorithm.

It is important that the test strip is reliably and correctly introduced into the sample chamber when the sample chamber and the analysis chamber are in communication with each other. This is necessary to ensure wicking of all of the sample solution, and to ensure that the test strip can be inspected (either visually or automatically) to read the result of the test, otherwise the test may be invalidated. If the test result is to be read by a camera, the test strip must be correctly aligned with the camera.

There is a need, therefore, to provide a device in which the test strip is reliably introduced into the sample chamber when the sample chamber and analysis chamber are in communication with each other. There is also a need to provide a device in which the test strip is reliably introduced into the sample chamber in correct alignment when the sample chamber and analysis chamber are in communication with each other to allow the test result to be read automatically, for example by a camera or an optical reader.

The invention provides a device for analysing a sample according to the appended independent claims, to which reference should now be made. Optional features of the invention are defined in dependent sub-claims.

According to the invention there is provided a device for analysing a sample, the device comprising: a sample chamber for receiving the sample having a first opening; an analysis chamber containing a test strip for analysing the sample, the analysis chamber having a second opening; the sample chamber being moveable relative to the analysis chamber to enable communication between the sample chamber and the analysis chamber when the first opening is disposed in an overlapping relationship with the second opening; and a resilient biasing member disposed in the analysis chamber and configured to exert a force against the test strip sufficient to urge the test strip into the sample chamber when the first opening is disposed in an overlapping relationship with the second opening.

The resilient biasing member ensures that the test strip enters the sample chamber when the sample chamber is moved into communication with the analysis chamber, thereby minimising any risk of invalidation of the test.

Optionally the sample chamber is rotatable relative to the analysis chamber to enable communication between the sample chamber and the analysis chamber when the first opening is disposed in an overlapping relationship with the second opening.

Optionally the resilient biasing member is disposed between a wall of the analysis chamber and the test strip. Optionally the wall of the analysis chamber is an end wall opposite the second opening.

Optionally the resilient biasing member extends sufficiently to maintain the test strip in position when the test strip has entered the sample chamber, and to prevent the test strip from coming out of the sample chamber.

Optionally the resilient biasing member contacts an end of the test strip. Optionally the resilient biasing member extends sufficiently to retain contact with the end of the test strip when the test strip has entered the sample chamber, thereby maintaining the test strip in position and preventing the test strip from coming out of the sample chamber.

Optionally the resilient biasing member extends to a length at least two times, three times, or four times its compressed length when the test strip has entered the sample chamber.

It will be appreciated that the force exerted by the resilient biasing member should not be too strong to cause deformation of the test strip either when the test strip is located entirely within the analysis chamber or when it is urged into the sample chamber.

Optionally the resilient biasing member has a cross-sectional shape which corresponds to a cross-sectional shape of an interior of the analysis chamber.

Optionally the resilient biasing member fits snugly within the analysis chamber to minimise movement of the resilient biasing member within the analysis chamber other than when urging the test strip into the sample chamber. For example, the fit may be such that lateral movement of the resilient biasing member is restricted to up to a quarter, or up to a fifth, of the width of the resilient biasing member.

Optionally the analyser chamber has a substantially rectangular interior cross section, and the resilient biasing member has a cross-sectional shape which is substantially rectangular.

Optionally the resilient biasing member is made of metal, for example steel, particularly stainless steel.

Optionally the resilient biasing member is a spring. Optionally the resilient biasing member is a compression spring. Optionally the spring is a helical spring, for example a helical compression spring. Optionally the spring is a closed spring, for example, a closed helical compression spring. In one example, the spring is a closed helical compression spring of substantially rectangular cross-section.

Optionally an end of the spring that contacts an end of the test strip comprises a closed coil that has a smaller diameter than other coils of the spring to ensure reliable contact of the spring with the end of the test strip.

Optionally the spring has a width of 1-10 mm. Optionally the spring is approximately 2 mm×5 mm in cross-section. Optionally the spring has a wire diameter of 0.05-2 mm.

Optionally the spring has a compressed length of 1-10 mm. Optionally the spring has an extended length of 5-20 mm. For example, the spring may have a compressed length of approximately 3 mm, and an extended length of approximately 10 mm.

Optionally the spring extends to a length at least two times, three times, or four times its compressed length when the test strip has entered the sample chamber.

Optionally an internal wall of the analysis chamber comprises a rib extending co-axially with the test strip, which reduces contact area between the wall of the analysis chamber and the test strip. Reduced contact area reduces friction between the test strip and the wall of the analysis chamber, and helps to ensure that the test strip is urged reliably into the sample chamber when the first opening is disposed in an overlapping relationship with the second opening.

There is also provided according to the invention a device for analysing a sample, the device comprising: a sample chamber for receiving the sample having a first opening; an analysis chamber containing a test strip for analysing the sample, the analysis chamber having a second opening; the sample chamber being moveable relative to the analysis chamber to enable communication between the sample chamber and the analysis chamber when the first opening is disposed in an overlapping relationship with the second opening to allow the test strip to enter the sample chamber, wherein an internal wall of the analysis chamber comprises a rib extending co-axially with the test strip, which reduces contact area between the wall of the analysis chamber and the test strip.

Optionally the rib extends for at least a third, or at least a half, of the length of the analysis chamber.

Optionally the rib extends from a closed end of the analysis chamber to at least a third, or at last half, of the way along the analysis chamber.

Optionally the sample chamber comprises first and second guide members for guiding the test strip into the sample chamber between the guide members, wherein a free end of each guide member is shaped to prevent significant rotation of the test strip about its direction of movement into the sample chamber when the test strip is disposed between the free ends of the guide members.

There is further provided according to the invention a device for analysing a sample, the device comprising: a sample chamber for receiving the sample having a first opening; an analysis chamber containing a test strip for analysing the sample, the analysis chamber having a second opening: the sample chamber being moveable relative to the analysis chamber to enable communication between the sample chamber and the analysis chamber when the first opening is disposed in an overlapping relationship with the second opening to allow the test strip to enter the sample chamber, wherein the sample chamber comprises first and second guide members for guiding the test strip into the sample chamber between the guide members, wherein a free end of each guide member is shaped to prevent significant rotation of the test strip about its direction of movement into the sample chamber when the test strip is disposed between the free ends of the guide members.

Optionally each guide member comprises a free end which is sufficiently flared to prevent significant rotation of the test strip disposed between the free ends of the guide members.

Optionally the flared free end of each guide member has a width which is greater than half, preferably greater than two thirds, of the width of the test strip.

The guide members ensure correct alignment of the test strip in the sample chamber for reading of a result on the test strip.

Optionally the free ends of the guide members are disposed opposite one another and spaced from one another by a distance that is sufficiently large to allow the test strip to pass between them into the sample chamber, but sufficiently small to prevent significant rotation of the test strip when disposed between them.

The term 'prevent significant rotation' is used herein to mean that the test strip cannot rotate sufficiently to prevent a result on the test strip being read by a camera, such as a line scan camera, or by an optical reader. Optionally the test strip cannot rotate more than 70° when disposed between the guide members. Optionally the test strip cannot rotate more than 60° when disposed between the guide members. Optionally the test strip cannot rotate more than 50° when disposed between the guide members. Optionally the test strip cannot rotate mom than 40° when disposed between the guide members. Optionally the test strip cannot rotate more than 30° when disposed between the guide members. Optionally the test strip cannot rotate more than 20° when disposed between the guide members. Optionally the test strip cannot rotate more than 10 when disposed between the guide members.

It will be appreciated that the extent to which the free ends of the guide members need to be flared to prevent significant rotation of the test strip will depend on the width of the test strip, the spacing between the free ends of the guide members, and the degree of rotation of the test strip that can be tolerated without preventing a result on the test strip being read by a camera, such as a line scan camera, or by an optical reader.

Optionally each guide member comprises a protrusion that extends inwardly from a side wall of the sample chamber towards a closed end of the sample chamber.

The sample chamber may comprise an insert comprising an upper ring with the first and second guide members extending inwardly from a side wall of the ring towards a closed end of the sample chamber.

Optionally each guide member is paddle-shaped.

Optionally the device comprises no more than two guide members.

Optionally the test strip is a chromatographic strip. The term "chromatographic strip" is used herein to mean any porous strip of material capable of transporting a solution by capillarity. The chromatographic strip may be capable of bibulous or non-bibulous lateral flow, but preferably bibulous lateral flow. By the term "non-bibulous lateral flow" is meant liquid flow in which all of the dissolved or dispersed components of the liquid are carried at substantially equal rates and with relatively unimpaired flow laterally through the membrane as opposed to preferential retention of one or more components as would occur with "bibulous lateral flow". Materials capable of bibulous lateral flow include paper, nitrocellulose, and nylon. A preferred example is nitrocellulose.

Optionally the test strip is a rectangular test strip. Optionally the test strip is at least two, three, four, or five times longer than its width. For example, the test strip may be approximately 5 mm×55 mm.

Optionally a device of the invention may comprise any of the additional features of the amplification devices described in WO 2008/012550 or WO 2014/140640.

Optionally a device of the invention may comprise:

- a location apparatus having an input port for receiving a sample and one or more reagents;
- a sample chamber for receiving the sample having a first opening;
- an analysis chamber containing a test strip for analysing the sample, the analysis chamber having a second opening;
- the sample chamber being moveable relative to the analysis chamber and the input port to enable communication between the sample chamber and the input port when the first opening is disposed in an overlapping relationship with the input port and communication between the sample chamber and the analysis chamber when the first opening is disposed in an overlapping relationship with the second opening.

Optionally a device of the invention may further comprise a sealing apparatus for sealing the sample chamber and the analysis chamber throughout communication between the sample chamber and the analysis chamber.

Optionally a device of the invention may further include one or more reagent chambers suitable for containing processing reagents. In use, the sample chamber is moved sequentially into communication with the reagent chambers and then into communication with the analysis chamber, to mix the reagents with the sample and so implement a processing protocol or method. Optionally the device also includes a sealing apparatus for sealing the sample chamber and the reagent chamber or chambers throughout processing of the sample.

Optionally a device of the invention may further comprise a sealing cap for sealing the input port prior to processing of the sample.

Optionally a device of the invention may be configured to be operated automatically by the system described in WO 2014/140640. In particular, the device may be configured to engage with the adaptor described in WO 2014/140640. For example, the device may comprise a sealing cap for sealing the input port prior to processing of the sample, the sealing cap being configured to engage with the adaptor.

Embodiments of the invention are now described, by way of example only, with reference to the accompanying drawings in which:

FIG. 1*a* shows a side view of a device according to an embodiment of the invention, in a configuration in which a test strip is located entirely within an analysis chamber of the device; FIG. 1*b* shows a side view of the device shown in FIG. 1*a*, in a configuration in which the test strip has been urged into the sample chamber:

Figure 1B:
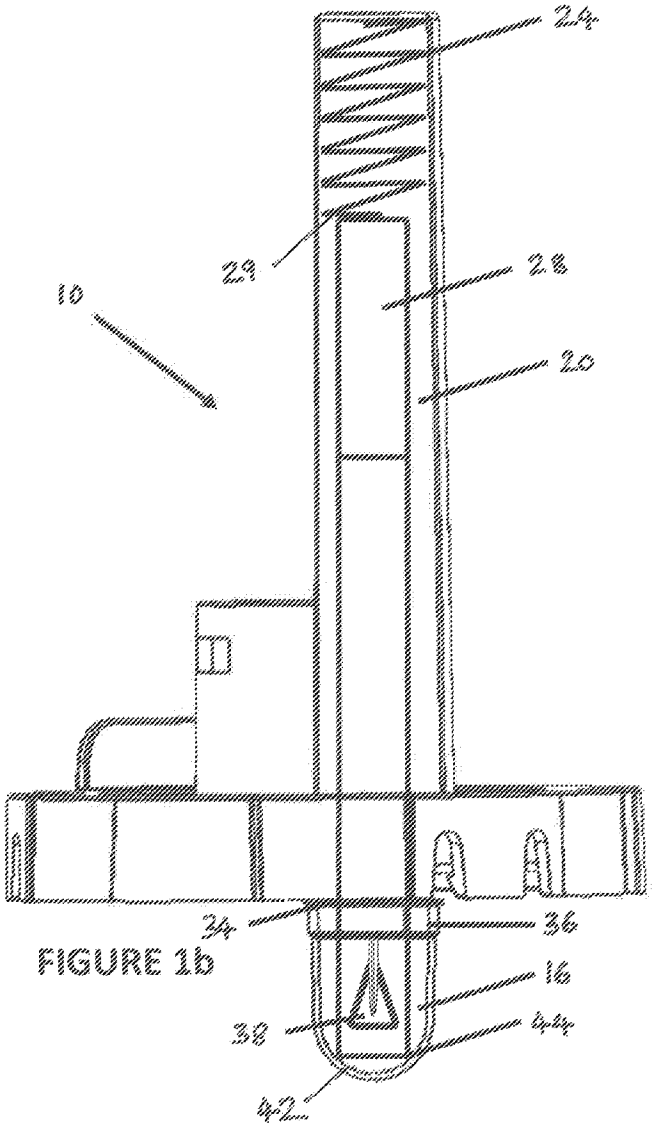
Figure 1A:
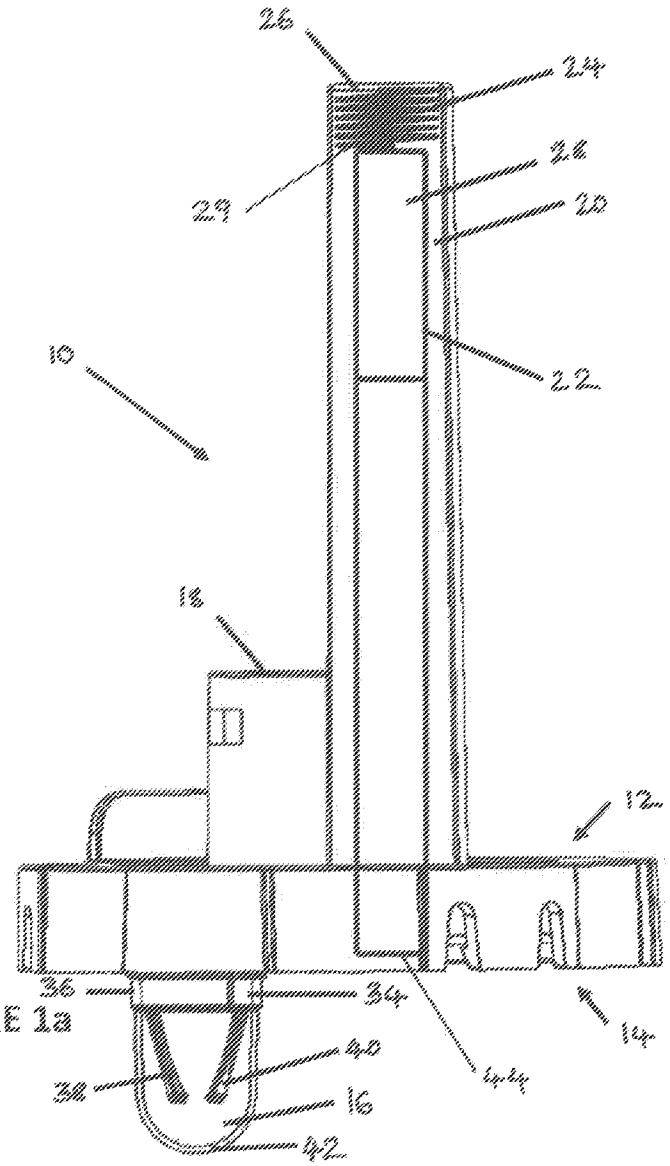
Figure 2:
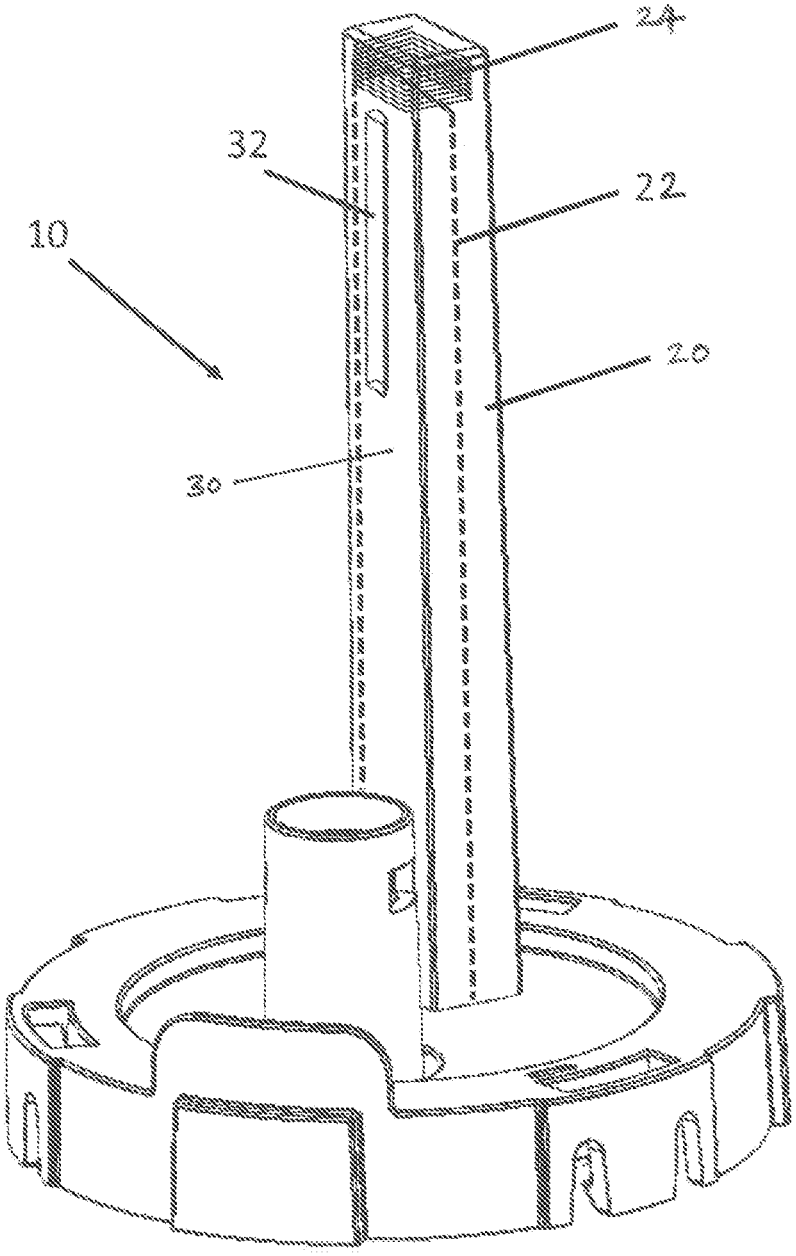
FIG. 2 shows a perspective view of the device shown in FIG. 1*a*.
Figure 3:
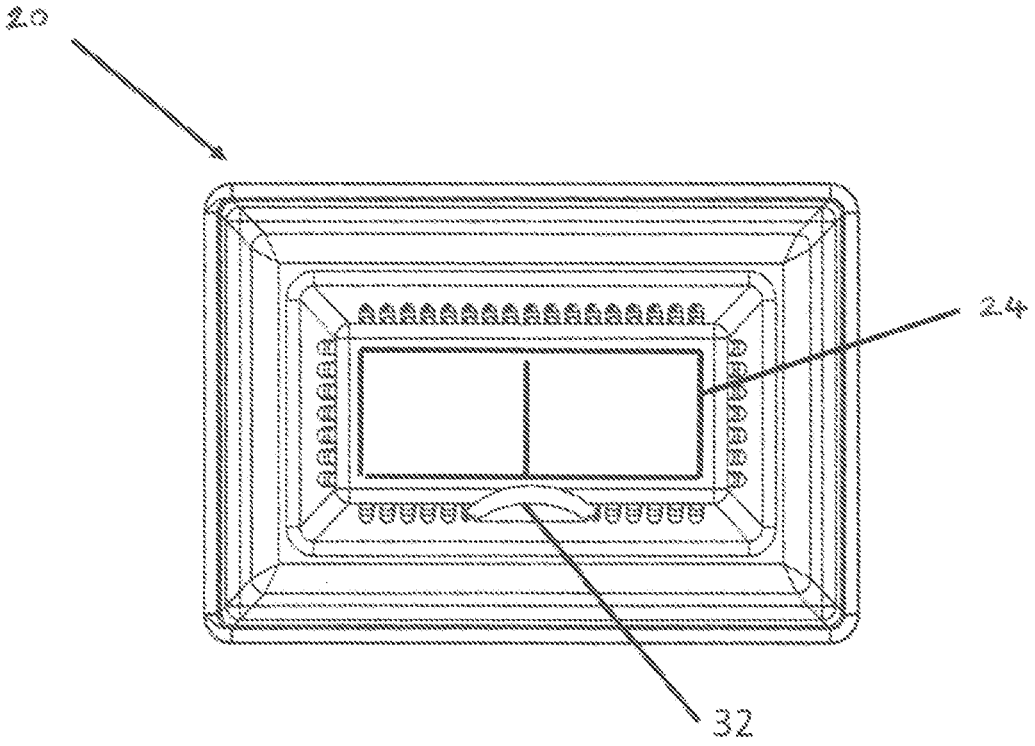
FIG. 3 shows a top view of the analysis chamber of the device shown in FIG. 1.

The device shown in FIGS. 1-3 is the same type of device as described at page 38, line 24—page 39, line 8 of WO 2014/140640, with reference to FIG. 11. This device is suitable for use with an automated system of the type described with reference to FIGS. 1 and 2 of WO 2014/140640 as part of a sample processing protocol. The device of the embodiment described herein differs from the device described with reference to FIG. 11 of WO2014/140640 by incorporation of a helical compression spring in the analysis chamber, and first and second guide members in the sample chamber (the sample chamber is referred to as the processing chamber in the device described in WO 2014/140640). FIGS. 1-3 herein have been simplified to remove the sealing cap for sealing the input port prior to processing of the sample, the sealing cap being configured to engage with the adaptor. The device shown in FIGS. 1-3 herein is described in more detail below.

The device 10 comprises an upper portion 12 and a lower portion 14 which are both formed from a mouldable plastics material. The upper and lower portions are both circular and rotatably engageable with each other. A sample chamber 16 is formed in the lower portion. An input port 18 and an analysis chamber 20 are formed in the upper portion. The sample chamber 16 has an upwardly facing opening through which a sample and reagents (and a test strip) can enter the sample chamber.

The analysis chamber 20 is a tall, thin chamber of substantially rectangular internal cross-section, and contains a test strip 22. The analysis chamber is transparent to allow the test strip to be visually inspected, or to be read by an optical reader. The analysis chamber has a downwardly facing opening through which the test strip can pass. A helical compression spring 24 (shown schematically in the figures) is disposed in the analysis chamber between a closed upper end 26 of the analysis chamber and an upper end 28 of the test strip. As seen in FIGS. 2 and 3, the helical compression spring is substantially rectangular in cross-section (i.e. coils of the helical spring follow a substantially rectangular path), and fits snugly within the closed upper end of the analysis chamber. A closed coil 29 at a lower end of the spring has a smaller diameter than other coils of the spring and contacts the upper end of the test strip approximately half-way along the top of the test strip. This ensures that a reliable contact is made between the lower end of the spring and the upper end of the test strip.

FIG. 1*a* shows the test strip held in the analysis chamber by the lower portion 14. In this initial position, the helical compression spring 24 is compressed between the closed end 26 of the analysis chamber 20 and the upper end 28 of the test strip 22. As seen in FIGS. 2 and 3 (with the helical spring in its compressed position), an internal side wall 30 of the analysis chamber comprises a rib 32 extending co-axially with the test strip. The rib extends from the closed upper end of the analysis chamber to approximately half-way down the analysis chamber. The rib 32 reduces contact area of the side wall of the analysis chamber with the test strip.

The sample chamber comprises an insert 34 comprising an upper ring 36 and first 38 and second 40 flexible but resilient guide members. Each guide member 38, 40 comprises a protrusion extending inwardly from a side wall of the upper ring 36 towards a closed lower end 42 of the sample chamber. A free end of each protrusion is flared so that each guide member is paddle-shaped. The flared free ends of the guide members are disposed opposite one another and spaced sufficiently far apart to allow a lower end 44 of the test strip to pass between them, but sufficiently close together to prevent significant rotation of the test strip in the sample chamber when disposed between the free ends of the guide members.

Once a sample has been processed, and it is desired to test the sample for presence of a specific amplified nucleic acid, the upper portion is rotated relative to the lower portion to a position in which the opening of the sample chamber is in an overlapping relationship with the opening of the analysis chamber. The test strip is urged by the helical spring into the sample chamber so that a lower end of the test strip is in contact with a processed sample in the sample chamber. In this position, shown in FIG. 1*b*, the helical spring is extended. The lower end of the helical spring remains in contact with the upper end of the test strip to retain the test strip in position in the sample chamber. The force exerted against the test strip by the helical spring is sufficient to urge the test strip into the sample chamber when the opening of the sample chamber is in an overlapping relationship with the opening of the analysis chamber, but not so strong as to cause deformation of the test strip by the force exerted by the helical spring either in its compressed or extended position. The rib 32 reduces the contact area of the test strip with the side wall of the analysis chamber, thereby reducing the frictional force acting against movement of the test strip into the sample chamber.

As the test strip is urged into the sample chamber by the action of the helical spring, the lower end of the test strip passes between the paddle-shaped guide members in the sample chamber. The guide members guide the test strip into position in the sample chamber, and the flared ends of the guide members ensure that the test strip does not rotate significantly once in position so that it is in correct alignment with an optical reader (not shown) able to read a result on the test strip. The force exerted by the spring ensures that the lower end 44 of the test strip contacts the bottom of the sample chamber so that all of the sample in the sample chamber wicks up the test strip by capillary action. The test strip is sensitive to the presence of a particular nucleic acid and provides a visual indication, such as a line on the test strip, if it contacts a sample containing that nucleic acid.

The invention claimed is:

1. A device for analyzing a sample, the device comprising:

a sample chamber for receiving the sample having a first opening;

an analysis chamber containing a test strip for analyzing the sample, the analysis chamber having a second opening;

the sample chamber being moveable relative to the analysis chamber to enable communication between the sample chamber and the analysis chamber when the first opening is disposed in an overlapping relationship with the second opening;

a resilient biasing member disposed in the analysis chamber and configured to exert a force against the test strip sufficient to urge the test strip into the sample chamber when the first opening is disposed in an overlapping relationship with the second opening, so that the test strip is automatically and reliably introduced into the sample chamber when the first opening is disposed in an overlapping relationship with the second opening; and a sealing apparatus for sealing the sample chamber and the analysis chamber throughout the communication between the sample chamber and the analysis chamber.

2. A device according to claim 1, wherein the resilient biasing member is disposed between a wall of the analysis chamber and the test strip.

3. A device according to claim 2, wherein the wall of the analysis chamber is an end wall opposite the second opening.

4. A device according to claim 1, wherein the resilient biasing member has a cross sectional shape which corresponds to a cross-sectional shape of the analysis chamber.

5. A device according to claim 1, wherein the resilient biasing member has a cross-sectional shape which is substantially rectangular.

6. A device according to claim 1, wherein the resilient biasing member is a spring.

7. A device according to claim 6, wherein an end of the spring comprises a closed coil that has a smaller diameter than other coils of the spring, and contacts an end of the test strip to ensure that the spring is able to urge the test strip with sufficient force.

8. A device according to claim 1, wherein an internal wall of the analysis chamber comprises a rib extending co-axially with the test strip, which reduces contact area between the wall of the analysis chamber and the test strip.

9. A device according to claim 8, wherein the rib extends for at least a third of the length of the analysis chamber.

10. A device according to claim 1, wherein the sample chamber comprises first and second guide members for guiding the test strip into the sample chamber between the guide members, wherein a free end of each guide member is shaped to prevent significant rotation of the test strip about its direction of movement into the sample chamber when the test strip is disposed between the free ends of the guide members.

11. A device according to claim 10, wherein each guide member comprises a free end which is sufficiently flared to prevent significant rotation of the test strip when the test strip is disposed between the free ends of the guide members.

12. A device for analyzing a sample, the device comprising:

a sample chamber for receiving the sample having a first opening;

an analysis chamber containing a test strip for analyzing the sample, the analysis chamber having a second opening;

the sample chamber being moveable relative to the analysis chamber to enable communication between the sample chamber and the analysis chamber when the first opening is disposed in an overlapping relationship with the second opening to allow the test strip to enter the sample chamber, wherein the sample chamber comprises first and second guide members for guiding movement of the test strip into the sample chamber between the guide members, wherein a free end of each guide member is shaped to prevent significant rotation of the test strip about its direction of movement into the sample chamber when the test strip is disposed between the free ends of the guide members to ensure correct alignment of the test strip in the sample chamber for reading of a result on the test strip.

13. A device according to claim 12, wherein each guide member comprises a free end which is sufficiently flared to prevent significant rotation of the test strip disposed between the free ends of the guide members.

14. A device according to claim 13, wherein the flared free end of each guide member has a width which is greater than half, preferably greater than two thirds, of the width of the test strip.

15. A device according to claim 12, wherein there are no more than two guide members.

16. A device according to claim 14, wherein the guide members are paddle shaped.

17. A device according to claim 12, wherein the guide members prevent rotation of the test strip by more than 50° when the test strip is disposed between the guide members.

18. A device for analyzing a sample, the device comprising:

a sample chamber for receiving the sample having a first opening;

an analysis chamber containing a test strip for analyzing the sample, the analysis chamber having a second opening;

the sample chamber being moveable relative to the analysis chamber to enable communication between the sample chamber and the analysis chamber when the first opening is disposed in an overlapping relationship with the second opening to allow the test strip to enter the sample chamber, wherein an internal wall of the analysis chamber comprises a rib extending co-axially with the test strip, which reduces contact area between the wall of the analysis chamber and the test strip, thereby reducing frictional force acting against movement of the test strip into the sample chamber to ensure reliable entry of the test strip into the sample chamber.

19. A device according to claim 18, wherein the rib extends for at least a third of the length of the analysis chamber.

* * * * *